US007086489B2

(12) United States Patent
McDonough

(10) Patent No.: US 7,086,489 B2
(45) Date of Patent: Aug. 8, 2006

(54) MULTI-LOBED CUTTER ELEMENT FOR DRILL BIT

(75) Inventor: Scott McDonough, Houston, TX (US)

(73) Assignee: Smith International, Inc., HOuston, TX (US)

( * ) Notice: Subject to any disclaimer, the term of this patent is extended or adjusted under 35 U.S.C. 154(b) by 0 days.

(21) Appl. No.: 11/113,747

(22) Filed: Apr. 25, 2005

(65) Prior Publication Data

US 2005/0189149 A1 Sep. 1, 2005

Related U.S. Application Data

(63) Continuation of application No. 10/335,493, filed on Jan. 31, 2003, now Pat. No. 6,883,624.

(51) Int. Cl.
*E21B 10/16* (2006.01)
*E21B 10/62* (2006.01)

(52) U.S. Cl. ..... 175/430; 175/398; 175/428

(58) Field of Classification Search ..... 175/331, 175/334, 335, 425, 428, 430, 376, 398, 426
See application file for complete search history.

(56) References Cited

U.S. PATENT DOCUMENTS

| | | | |
|---|---|---|---|
| 2,578,593 | A | 12/1951 | Phipps |
| 3,388,757 | A | 6/1968 | Fittinger |
| 3,442,352 | A | 5/1969 | McElya et al. |
| 3,946,820 | A | 3/1976 | Knapp |
| 4,056,153 | A | 11/1977 | Miglierini |
| 4,058,177 | A | 11/1977 | Langford, Jr. et al. |
| 4,086,973 | A | 5/1978 | Keller et al. |
| 4,108,260 | A | 8/1978 | Bozarth |
| 4,334,586 | A | 6/1982 | Schumacher |
| 4,352,400 | A | 10/1982 | Grappendorf et al. |
| 4,511,006 | A | 4/1985 | Grainger |
| 4,586,574 | A | 5/1986 | Grappendorf |
| 4,716,977 | A | 1/1988 | Huffstutler |
| 4,722,405 | A | 2/1988 | Langford, Jr. |
| 4,832,139 | A | 5/1989 | Minikus et al. |
| 4,951,762 | A | 8/1990 | Lundell |
| D324,527 | S | 3/1992 | Slutz |
| 5,131,478 | A | 7/1992 | Brett et al. |
| 5,172,777 | A | 12/1992 | Siracki et al. |
| 5,172,779 | A | 12/1992 | Siracki et al. |
| 5,197,555 | A | 3/1993 | Estes |
| 5,201,376 | A | 4/1993 | Williams |

(Continued)

FOREIGN PATENT DOCUMENTS

| | | |
|---|---|---|
| EP | 0 391 683 | 10/1990 |

(Continued)

OTHER PUBLICATIONS

Search Report for Appln. No. GB0402108.5 dated Jul. 27, 2005, (1 p.).

(Continued)

*Primary Examiner*—Jennifer H. Gay
(74) *Attorney, Agent, or Firm*—Conley Rose, P.C.

(57) ABSTRACT

Disclosed are cutter elements for a drill bits having particular, but not exclusive, application on the nose portion of the cone cutters of a rolling cone bit. The cutter elements include a base, a cutting portion, and a plurality of cutting lobes extending radially from the cutting portion. Each lobe includes a forward-facing cutting face and trailing portion having a trailing surface that intersects the cutting face in a nonlinear cutting edge. The trailing surface is non-planar and recedes away from the cutting edge. In certain embodiments, the trailing surface is a partial dome shaped surface. The trailing portion provides strength and buttresses the cutting edge.

21 Claims, 8 Drawing Sheets

U.S. PATENT DOCUMENTS

| | | | | |
|---|---|---|---|---|
| 5,303,787 | A | 4/1994 | Brady | |
| 5,322,138 | A | 6/1994 | Siracki | |
| 5,323,865 | A | 6/1994 | Isbell et al. | |
| 5,341,890 | A | 8/1994 | Cawthorne et al. | |
| 5,351,768 | A | 10/1994 | Scott et al. | |
| 5,372,210 | A | 12/1994 | Harrell | |
| 5,407,022 | A | 4/1995 | Scott et al. | |
| 5,415,244 | A | 5/1995 | Portwood | |
| 5,421,423 | A | 6/1995 | Huffstutler | |
| 5,421,424 | A | 6/1995 | Portwood et al. | |
| 5,429,199 | A | 7/1995 | Sheirer et al. | |
| 5,429,200 | A | 7/1995 | Blackman et al. | |
| 5,452,771 | A | 9/1995 | Blackman et al. | |
| 5,479,997 | A | 1/1996 | Scott et al. | |
| 5,518,077 | A | 5/1996 | Blackman et al. | |
| 5,535,839 | A | 7/1996 | Brady | |
| 5,542,485 | A | 8/1996 | Pessier et al. | |
| 5,560,440 | A | 10/1996 | Tibbits | |
| 5,592,995 | A | 1/1997 | Scott et al. | |
| 5,636,700 | A | 6/1997 | Shamburger, Jr. | |
| 5,644,956 | A | 7/1997 | Blackman et al. | |
| 5,695,019 | A | 12/1997 | Shamburger, Jr. | |
| 5,697,462 | A | 12/1997 | Grimes et al. | |
| 5,709,278 | A | 1/1998 | Crawford | |
| 5,746,280 | A | 5/1998 | Scott et al. | |
| 5,752,573 | A | 5/1998 | Scott et al. | |
| 5,755,301 | A | 5/1998 | Love et al. | |
| 5,813,485 | A | 9/1998 | Portwood | |
| 5,819,861 | A | 10/1998 | Scott et al. | |
| 5,833,020 | A | 11/1998 | Portwood et al. | |
| 5,839,526 | A | 11/1998 | Cisneros et al. | |
| 5,871,060 | A | 2/1999 | Jensen et al. | |
| 5,874,060 | A | 2/1999 | Armour et al. | |
| 5,881,828 | A | 3/1999 | Fischer et al. | |
| 5,887,655 | A | 3/1999 | Haugen et al. | |
| 5,887,668 | A | 3/1999 | Haugen et al. | |
| 5,890,550 | A | 4/1999 | Swadi et al. | |
| 5,915,486 | A | 6/1999 | Portwood et al. | |
| 5,950,745 | A | 9/1999 | Ingmarsson | |
| 5,967,245 | A | 10/1999 | Garcia et al. | |
| 6,029,759 | A | 2/2000 | Sue et al. | |
| 6,053,263 | A | 4/2000 | Meiners | |
| 6,059,054 | A | 5/2000 | Portwood et al. | |
| 6,105,693 | A | 8/2000 | Ingmarsson | |
| D430,578 | S | 9/2000 | Brady | |
| 6,119,798 | A * | 9/2000 | Fischer et al. | 175/420.2 |
| 6,176,332 | B1 | 1/2001 | Massa et al. | |
| 6,176,333 | B1 | 1/2001 | Doster | |
| 6,196,340 | B1 | 3/2001 | Jensen et al. | |
| 6,202,752 | B1 | 3/2001 | Kuck et al. | |
| 6,241,034 | B1 | 6/2001 | Steinke et al. | |
| 6,595,305 | B1 | 7/2003 | Dunn et al. | |
| 6,601,662 | B1 | 8/2003 | Matthias et al. | |
| 6,883,623 | B1 * | 4/2005 | McCormick et al. | 175/408 |
| 6,883,624 | B1 * | 4/2005 | McDonough | 175/428 |
| 2002/0108789 | A1 * | 8/2002 | Schautt | 175/420.1 |
| 2004/0149493 | A1 * | 8/2004 | McDonough | 175/331 |
| 2004/0163851 | A1 * | 8/2004 | McDonough et al. | 175/374 |
| 2004/0173384 | A1 * | 9/2004 | Yong et al. | 175/374 |

FOREIGN PATENT DOCUMENTS

| | | |
|---|---|---|
| EP | 0 446 765 | 9/1991 |
| EP | 0 527 506 | 2/1993 |
| EP | 0 902 159 | 3/1999 |
| GB | 2 361 497 | 10/2001 |
| GB | 2 369 841 | 6/2002 |
| GB | 2 393 982 | 4/2004 |
| RU | 2105124 | 2/1998 |
| RU | 2153569 | 7/2000 |

OTHER PUBLICATIONS

Search Report for Appln. No. GB0403620.8 dated May 5, 2004, (2 p.).

Search Report for Appln. No. GB0402108.5 dated Apr. 22, 2004, (1 p.).

* cited by examiner

MULTI-LOBED CUTTER ELEMENT FOR DRILL BIT

CROSS-REFERENCE TO RELATED APPLICATIONS

This application is a continuation of U.S. application Ser. No. 10/355,493 filed Jan. 31, 2003, entitled "Multi-Lobed Cutter Element for Drill Bit", incorporated herein by references, issued as U.S. Pat. No. 6,883,624.

STATEMENT REGARDING FEDERALLY SPONSORED RESEARCH OR DEVELOPMENT

Not applicable.

FIELD OF THE INVENTION

The invention relates generally to earth-boring bits used to drill a borehole for the ultimate recovery of oil, gas or minerals. More particularly, the invention relates to rolling cone rock bits and to an improved cutting structure for such bits. Still more particularly, the invention relates to enhancements in inner row cutter elements.

BACKGROUND OF THE INVENTION

An earth-boring drill bit is typically mounted on the lower end of a drill string and is rotated by revolving the drill string at the surface or by actuation of downhole motors or turbines, or by both methods. With weight applied to the drill string, the rotating drill bit engages the earthen formation and proceeds to form a borehole along a predetermined path toward a target zone. The borehole formed in the drilling process will have a diameter generally equal to the diameter or "gage" of the drill bit.

A typical earth-boring bit includes one or more rotatable cone cutters that perform their cutting function due to the rolling movement of the cone cutters acting against the formation material. The cone cutters roll and slide upon the bottom of the borehole as the bit is rotated, the cone cutters thereby engaging and disintegrating the formation material in its path. The rotatable cone cutters may be described as generally conical in shape and are therefore referred to as rolling cones.

Rolling cone bits typically include a bit body with a plurality of journal segment legs. The rolling cones are mounted on bearing pin shafts that extend downwardly and inwardly from the journal segment legs. The borehole is formed as the gouging and scraping or crushing and chipping action of the rotary cones remove chips of formation material which are carried upward and out of the borehole by drilling fluid which is pumped downwardly through the drill pipe and out of the bit.

The earth disintegrating action of the rolling cone cutters is enhanced by providing the cone cutters with a plurality of cutter elements. Cutter elements are generally of two types: inserts formed of a very hard material, such as tungsten carbide, that are press fit into undersized apertures in the cone surface; or teeth that are milled, cast or otherwise integrally formed from the material of the rolling cone. Bits having tungsten carbide inserts are typically referred to as "TCI" bits, while those having teeth formed from the cone material are commonly known as "steel tooth bits." In each instance, the cutter elements on the rotating cone cutters breakup the formation to form new borehole by a combination of gouging and scraping or chipping and crushing.

In oil and gas drilling, the cost of drilling a borehole is proportional to the length of time it takes to drill to the desired depth and location. The time required to drill the well, in turn, is greatly affected by the number of times the drill bit must be changed in order to reach the targeted formation. This is the case because each time the bit is changed, the entire string of drill pipes, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is always desirable to employ drill bits which will drill faster and longer and which are usable over a wider range of formation hardness.

The length of time that a drill bit may be employed before it must be changed depends upon its ability to "hold gage" (meaning its ability to maintain a full gage borehole diameter), its rate of penetration ("ROP"), as well as its durability or ability to maintain an acceptable ROP. The form and positioning of the cutter elements (both steel teeth and tungsten carbide inserts) upon the cone cutters greatly impact bit durability and ROP and thus, are critical to the success of a particular bit design.

The inserts in TCI bits are typically inserted in circumferential rows on the rolling cone cutters. Most such bits include a row of inserts in the heel surface of the rolling cone cutters. The heel surface is a generally frustoconical surface and is configured and positioned so as to align generally with and ream the sidewall of the borehole as the bit rotates. The heel inserts function primarily to maintain a constant gage and secondarily to prevent the erosion and abrasion of the heel surface of the rolling cone.

In addition to the heel row inserts, conventional bits typically include a circumferential gage row of cutter elements mounted adjacent to the heel surface but oriented and sized in such a manner so as to cut the corner of the borehole. Conventional bits also include a number of additional rows of cutter elements that are located on the cones in circumferential rows disposed radially inward or in board from the gage row. These cutter elements are sized and configured for cutting the bottom of the borehole, and are typically described as inner row cutter elements.

Typically positioned on or near the apex of one or more of the rolling cone cutters, are cutter elements commonly referred to as a nose cutter or nose row cutters. Such cutters are generally responsible for cutting the central portion (or core) of the hole bottom. They may be positioned as a single cutter at or very near the apex of the cone cutter, or may be disposed in a circumferential row of several cutter element near to the cone apex.

In conventional TCI bits, conventional nose row cutters are typically of the chisel-shaped or conical designs. A chisel-shaped insert possesses a crest forming an elongated cutting edge that impacts the core portion of the hole bottom. By contrast, as compared to a standard chisel-shaped cutter, a conical insert is considered less aggressive as it has a relatively blunt cutting surface, and does not include the relatively sharp cutting edge of the chisel's crest. With only one cutting edge, a chisel-shaped insert employed as a nose row cutter will only contact the core approximately 1.25 times per bit revolution. At the same time, due to their greater numbers, a row of cutter elements in other locations on each cone contact the hole bottom with much greater frequency and thereby remove formation material faster than at the borehole center. In certain formations, this may result in a core of material that remains uncut and builds up in the center of the borehole, causing the drilling of the borehole to be slower and more costly. Furthermore, the cutting crest of a conventional chisel shaped cutter element is relatively thin relative to the overall diameter of the cutter element. For example, the standard chisel shaped cutter element has relatively little supporting material to oppose a side force that is imposed on the opposite side of the chisel face. In part for this reason, chisel shaped inserts, particularly in hard formations, will tend to chip, and may break, more readily than a more blunt surface conical shaped insert, for example.

Accordingly, there remains a need in the art for a nose row insert with a more aggressive cutting surface, so as to remove more material from the hole bottom with fewer revolutions of the bit. Such an enhanced design would result in a higher ROP and an increase in the footage drilled. At the same time, however, the cutter element should be able to withstand drilling in formations typically encountered when drilling with TCI bits. Thus, the desire for a more aggressive nose row cutter must be tempered by the need for providing a durable and relatively long-lasting cutter, one that will resist breakage even in formations harder than those typically drilled with steel tooth bits.

BRIEF SUMMARY OF THE PREFERRED EMBODIMENTS OF THE INVENTION

Preferred embodiments of the invention are disclosed which provide an earth boring bit having enhancements in cutter element design that provide the potential for increased ROP, as compared with bits employing cutter elements of conventional shape. The embodiments disclosed include cutter elements having aggressive cutting surfaces that have particular application in the nose region of a rolling cone cutter.

The cutter elements of the present invention are preferably disposed on the nose portion of a cone cutter of a rolling cone bit, but may be employed elsewhere on the cone cutter. The cutter elements include a base, a cutting portion extending from the base, and a plurality of cutting lobes extending radially from the cutting portion. In certain embodiments, each lobe preferably includes a generally forward-facing cutting face, and a non-planar trailing surface, with the two surfaces meeting to form a nonlinear cutting edge. The trailing surface recedes away from the cutting edge, and may have a partial dome shape, a frustoconical surface, or other shapes. In certain preferred designs, the forward facing surface is substantially planar and extends generally parallel to the axis of the cutter element. The forward facing surface may be coplanar with, or offset from, a plane containing the axis. In other embodiments, the forward facing surface may be canted so as to form an angle relative to the central axis. The forward facing surface may likewise be curved, rather than substantially planar as may be advantageous for use in certain formations. The number of lobes on the cutting surface may vary depending upon the type of formation and the size of the bit and cutter element. The extending lobes may be recessed so as not to extend radially beyond the profile of the cutter element base, or may extend beyond the base profile so as to create relatively large lobes and large forward facing cutting surfaces and cutting edges as particularly advantageous when drilling in soft formation.

The cutter elements and drill bits described herein provide an aggressive cutting structure and cutter element having multiple cutting edges offering enhancements in ROP given that the cutter's multiple cutting edges will engage and cut the borehole bottom more times per bit revolution than conventional cutter elements having only a single cutting edge (chisel shaped) or the conventional conical cutter having only a relatively blunt cutting surface. Providing a trailing portion behind the forward facing cutting surface and a trailing surface on the trailing position that extends to the cutting edge provides substantial strength to the cutting lobes by buttressing the forward facing cutting surface and lessening the likelihood of the lobe chipping and breaking. Thus, it is believed that the inserts described herein provide a robust and durable cutter element particularly well suited for use in the nose row of a cone cutter on a rolling cone bit.

It will be understood that the number, size and spacing of the lobes may vary according to the application. The bits, rolling cone cutters, and cutter elements described herein provide opportunities for greater improvement in ROP. These and various other characteristics and advantages will be readily apparent to those skilled in the art upon reading the following detailed description of the preferred embodiments of the invention, and by referring to the accompanying drawings.

BRIEF DESCRIPTION OF THE DRAWINGS

For an introduction to the detailed description of the preferred embodiments of the invention, reference will now be made to the accompanying drawings, wherein.

DETAILED DESCRIPTION OF THE PREFERRED EMBODIMENTS

Figure 1:
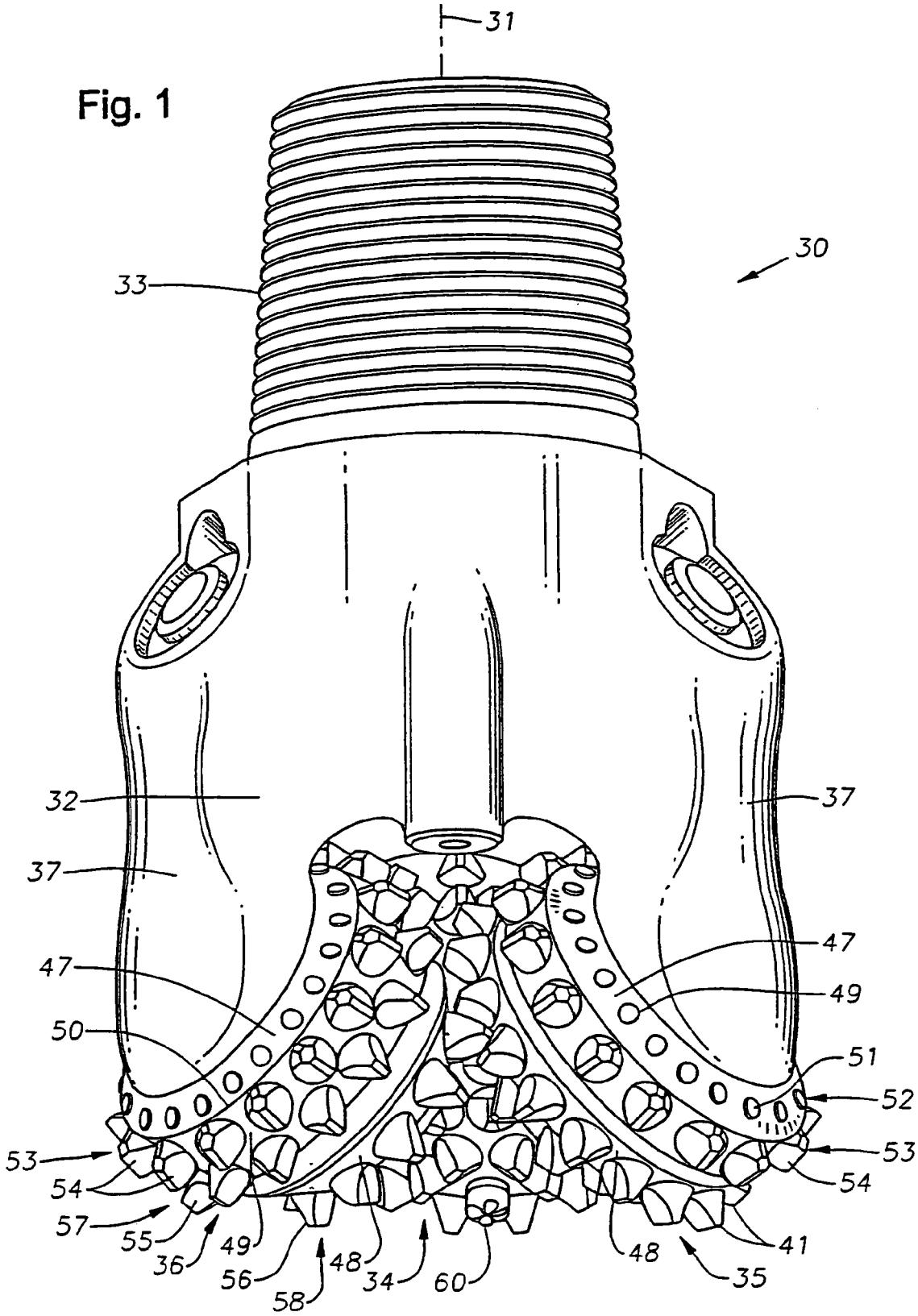
FIG. 1 is an elevation view of an earth-boring bit.

Referring first to FIG. 1, an earth-boring bit 30 includes a central axis 31 and a bit body 32 having a threaded section 33 on its upper end for securing the bit to the drill string (not shown). Bit 30 has a predetermined gage diameter as defined by three rolling cone cutters 34, 35, 36 rotatably mounted on bearing shafts (not shown) that depend from the bit body 32. The present invention will be understood with a detailed description of one such cone cutter 34, with cones 35, 36 being similarly, although not necessarily identically, configured. Bit body 32 is composed of three sections, or legs 37 (two shown in FIG. 1), that are jointed together to form bit body 32.

Figure 2:
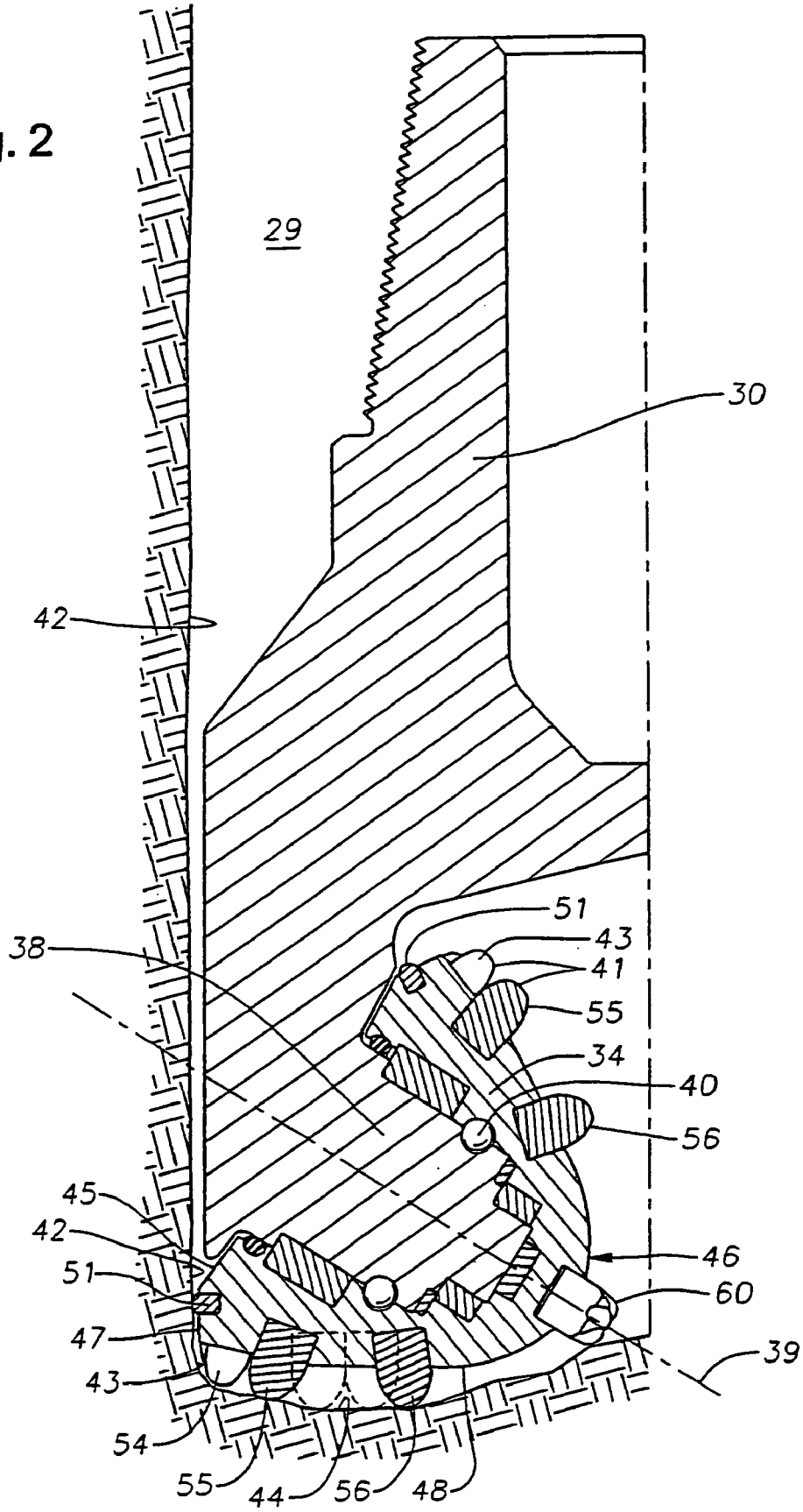
FIG. 2 is a partial cross sectional view of the bit of FIG. 1 inside of a borehole.
Figure 2A:
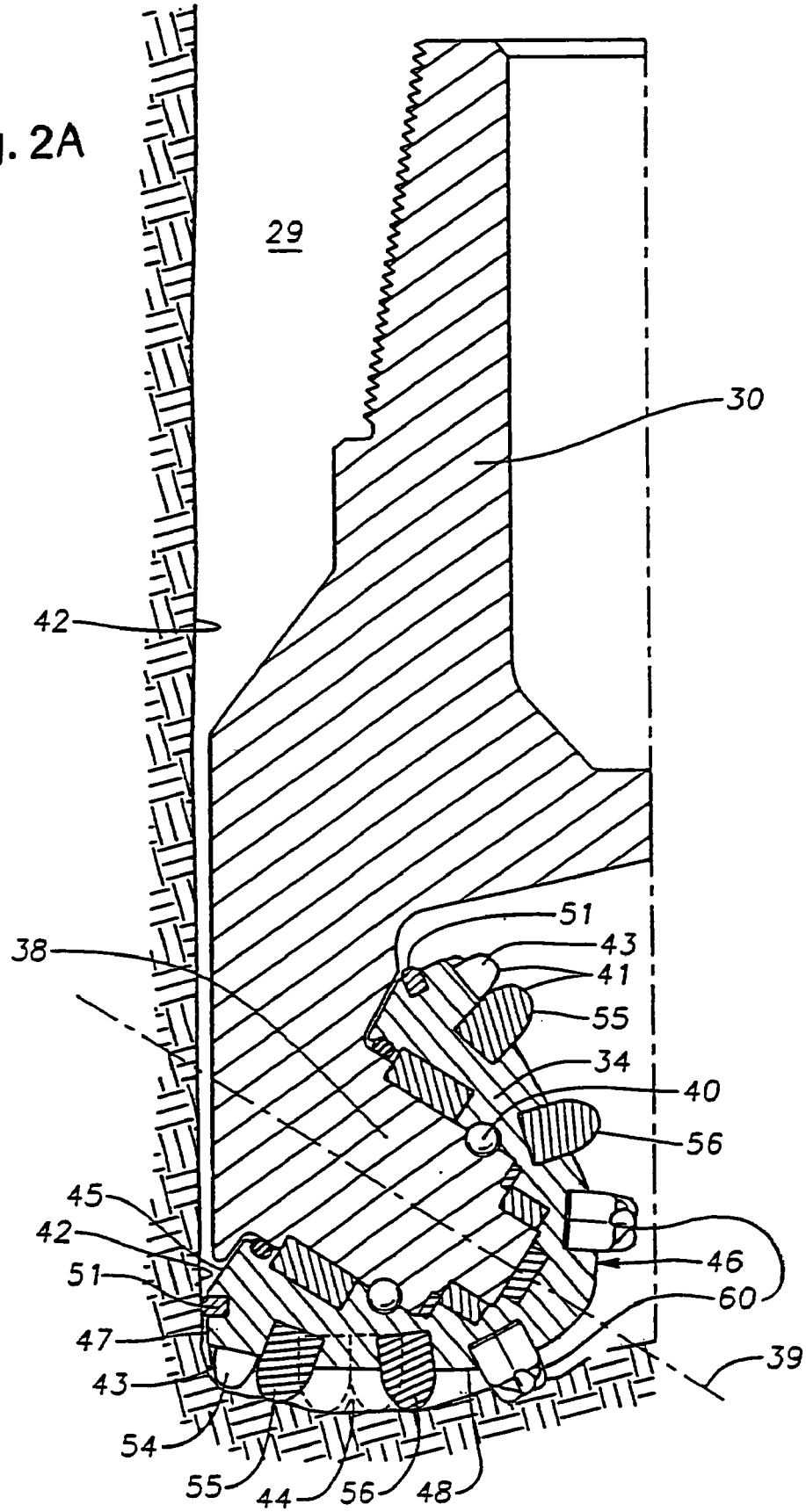

Referring now to FIG. 2, bit 30 is shown inside a borehole 29 that includes sidewall 42, corner portion 43 and bottom 44. Cone cutter 34 is rotatably mounted on a pin or journal 38, with an axis of rotation 39 oriented generally downward and inward towards the center of bit 30. Cone cutter 34 is secured on pin 38 by ball bearings 40. Cutters 34-36 include a plurality of tooth-like cutter elements 41, for gouging and chipping away the surfaces of a borehole.

Referring still to FIGS. 1 and 2, each cone cutter 34-36 includes a backface 45 and nose portion 46 generally opposite backface 45. Cutters 34-36 further include a frustoconical heel surface 47 that is adapted to retain cutter elements 51 that scrape or ream sidewall 42 of the borehole as cutters 34–36 rotate about borehole bottom 44. Frustoconical surface 47 is referred to herein as the "heel" surface of cutters 34–36, it being understood, however, that the same surface may be sometimes referred to by others in the art as the "gage" surface of a rolling cone cutter. Extending between heel surface 47 and nose 46 is a generally conical surface 48 adapted for supporting cutter elements 41 which gouge or crush the borehole bottom 44 as the cone cutters 34–36 rotate about the borehole.

Referring back to FIG. 1, conical surface 48 typically includes a plurality of generally frustoconical segments 49, generally referred to as "lands," which are employed to support and secure cutter elements 41. Frustoconical heel surface 47 and conical surface 48 converge in a circumferential edge or shoulder 50. Cutter elements 41 retained in cone cutter 34 include a plurality of heel row inserts 51 that are secured in a circumferential row 52 in the frustoconical heel surface 47. Cone cutter 34 further includes a circumferential row 53 of gage inserts 54 secured to cone cutter 34 in locations along or near the circumferential shoulder 50. Cone cutter 34 further includes a plurality of inner row inserts, such as inserts 55 and 56 secured to cone surface 48 and arranged in spaced-apart inner rows 57 and 58, respectively.

Referring again to FIG. 2, heel inserts 51 generally function to scrape or ream the borehole sidewall 42 to maintain the borehole at full gage and prevent erosion and abrasion of heel surface 47. Cutter elements 55 and 56 of inner rows 57 and 58 are employed primarily to gouge and crush and thereby remove formation material from the borehole bottom 44. Inner rows 57 and 58, are arranged and spaced on cone cutter 34 so as not to interfere with the inner rows on each of the other cone cutters 35, 36.

In the embodiment shown in FIGS. 1 and 2, each cone cutter 34–36 includes at least one cutting element on nose portion 46 spaced radially inward from inner rows 57 and 58, herein referred to as a nose insert 60. As cone cutters 34–36 rotate about their respective axis 39, nose inserts 60 gouge and remove the central or core portion of the borehole.

Figure 3A:
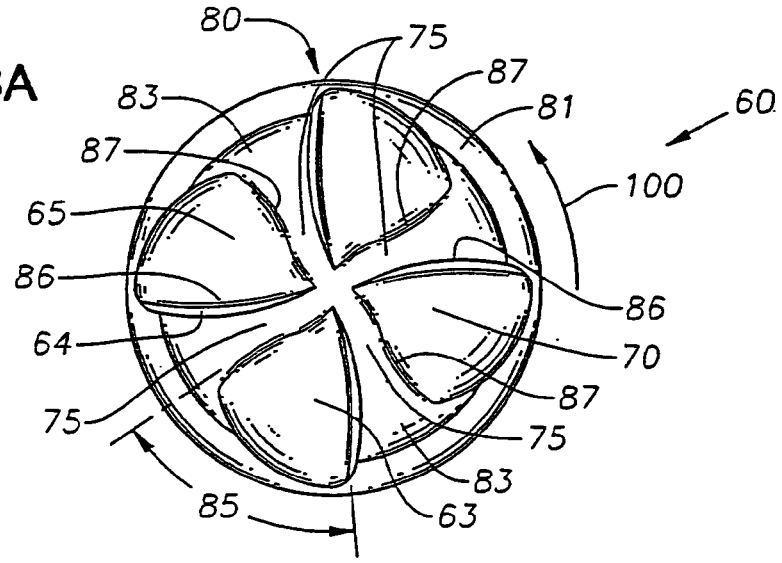
FIG. 3A is a top view of a first embodiment of the present invention.
Figure 3B:
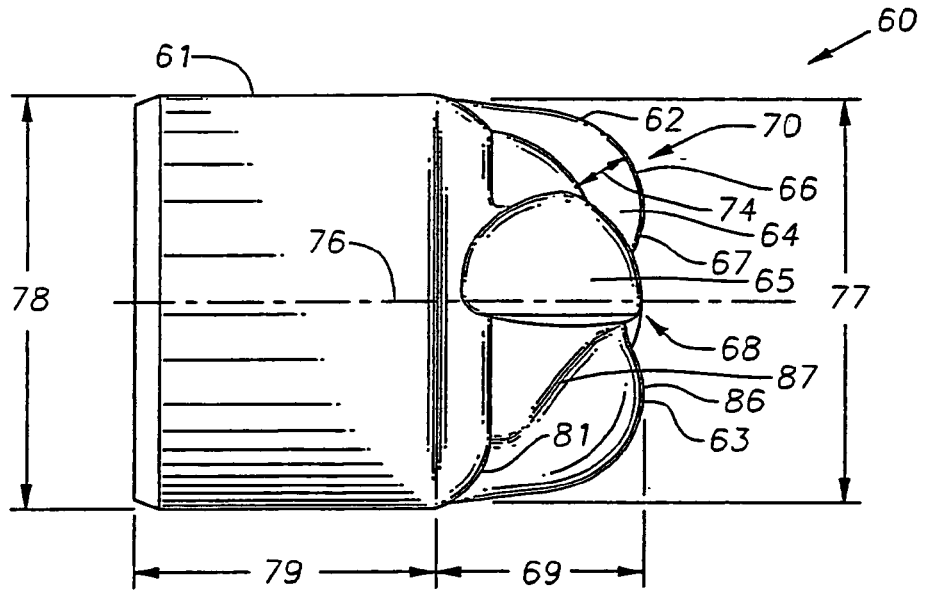
FIG. 3B is a side view of a first embodiment of the present invention.
Figure 3C:
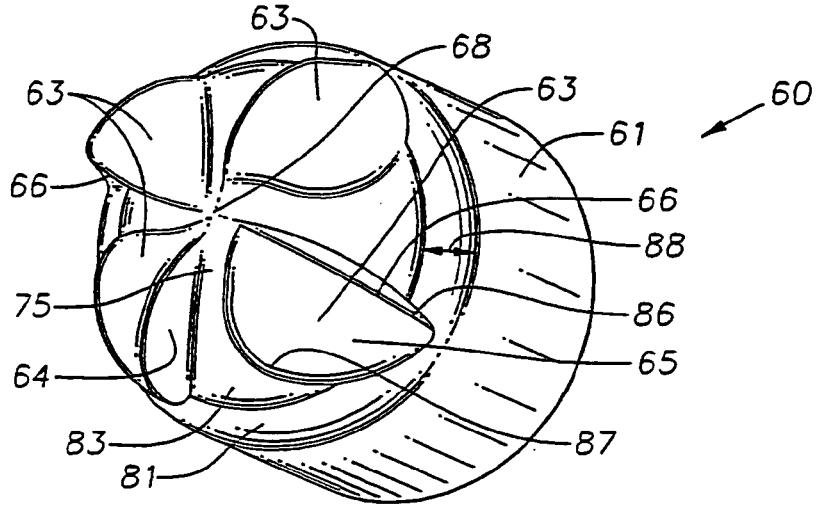
FIG. 3C is a perspective view of a first embodiment of the present invention.

Nose insert 60, best shown in FIG. 3A–3C, generally includes a cylindrical base portion 61 and a cutting portion 62 extending therefrom. Cutting portion 62 has a cutting surface 70. Central axis 76 extends through insert 60 and its cutting surface 70. In this embodiment, base 61 is generally cylindrical having a diameter 78 and a height 79, although other shapes for base portion 61 may be employed. Base 61 is embedded and retained in cone 34, as shown in FIG. 2, and cutting portion 62 extends beyond the steel of the cone cutter. Cutting portion 62 has an extension length 69 and includes a plurality of radiating lobes 63, each such lobe 63 having a forward facing surface or face 64 and a partial dome shaped trailing surface 65, the two surfaces meeting to form a nonlinear cutting edge 66. Cutting edge 66 has a radius of curvature 67 that changes along its length in these preferred embodiments. The lobes 63 extend generally radially away from central axis 76 but need not extend entirely to the axis. Cutting portion 62 joins base 61 in a radiused circumferential shoulder 81. Lobe 63 emanates from shoulder 81 such that cutting edge 66 extends upward from shoulder 81 toward the center 68 of the cutting surface 70, where the cutting surface 70 intersects with central axis 76.

Partial dome shaped trailing surface 65 includes leading end 86 and trailing end 87, leading end 86 being coextensive with cutting edge 66 and trailing end 87 being angularly spaced therefrom. Leading end 86 extends radially nearly to the outer profile of base 61, while trailing end 87 is further recessed from the outer profile 80 of the base, such recess at end 87 being designated by reference numeral 88 shown in FIG. 3C.

Referring to FIG. 3A, insert 60 is retained and oriented in a cone cutter 34 so as to engage the formation in the direction designated by reference numeral 100. In this orientation, forward facing surface 64 constitutes the first portion of the cutting surface of each lobe 63 to contact the formation material as the bit is rotated. Forward facing surface 64 is separated from the trailing end 87 of the immediately adjacent lobe 63 by a channel 75. As shown in FIG. 3A, channel 75 generally radiates across cutting surface 70 from point 68 so as to form a pattern of crossing interstitial channels 75. Channels 75 are narrowest adjacent point 68 and widen into generally wedge shaped portions 83 adjacent to shoulder 81. As best shown in FIG. 3B, in this embodiment, forward facing cutting surface 64 is generally planar and is substantially parallel to central axis 76, however, surface 64 may alternatively be tilted or canted at an angle relative to axis 76, and may be curved.

As best shown in FIGS. 3A, 3C, because the trailing end 87 of partial dome shaped trailing surface 65 is recessed or relieved further from the base profile than is leading end 86, fluid flow enhanced around the cutter element, thus promoting cleaning of the cutter which tends to enhance its cutting action. Thus, in this embodiment, the outer dimensions 77 and overall profile of cutting portion 62 are smaller than, and are contained within, the outer profile 80 of base 61, such that, lobes 63 do not extend beyond the profile of base 61.

Referring to FIG. 3B, height 74 of the forward facing surface 64 is dictated by the extension length 69 of the cutter portion, the overall diameter 78 of the base portion, and the radius of curvature 67 along cutting edge 66. Height 74 may generally be defined as the dimension between cutting edge 66 and the bottom of channel 75 taken where such a measurement is at a maximum.

Likewise, lobes 63 and their position on cutting portion 62 may be described in terms of their angular length. More particularly, and is best shown in FIG. 3A, the angular length of each lobe 63 as measured between forward facing surface 64 and trailing end 87 is represented by angle 85 which, in this embodiment is approximately 70°. The angular length of each lobe 63 may vary. Preferably, lobe 63 will have an angular length of at least twenty degrees or more so as to properly support the cutting face. Lobes having angular lengths of 45 degrees or more provide greater strength and support. In a general sense, the harder the formation, the greater the angular length of lobe 63. It being understood, of course, that the angular length of the lobe is also dependent upon the number of lobes on the cutting surface.

The insert of FIGS. 3A–3C is advantageously employed in an inner row of one or more cone cutters 34–36, and most preferably is employed in the nose row. In such a position, as shown in FIGS. 1 and 2, with its four forward facing cutting surfaces 64 with curved cutting edges 66, nose insert 60 provides enhancements in the ability of the bit to cut the central core of the borehole, given its relatively sharp and increased number of cutting edges as compared to the conventional conical shaped insert or chisel shaped inserts typically used in a nose row. For example, in comparison to a chisel shaped insert which has a cutting edge that contacts the core approximately 1.25 times per bit revolution, nose row cutter 60 described above will contact the core portion approximately 5 times per bit revolution. The relatively sharp cutting edge 66 is buttressed by the substantial amount of insert material in the trailing, partial dome shaped portion of the lobe so as to resist breakage and provide substantial durability to the insert.

The multiple lobes and cutting faces, as explained above, provide more impacts or scraps on the hole bottom per revolution of the bit. This increased number of impacts helps to prevent core buildup in the borehole bottom as was prevalent with conventional nose row cutter elements that do not possess multiple cutting edges on the nose row cutter. The relatively sharp cutting edges of the multiple lobe cutter aggressively cut the formation material; however, at the same time, the cutting edge 66 and forward facing surface 64 is well supported by the partial dome shaped portion 65 that trails the cutting edge so as to provide substantial support and back up to prevent the cutting edge from chipping or breaking prematurely. Accordingly, the cutter element 60 described herein promotes enhanced cutting of the core bottom, particularly the central core, while providing durability that would surpass that of a paddle-like cutting blade that did not have the dome shaped portion backing up the blade.

Figure 4A:
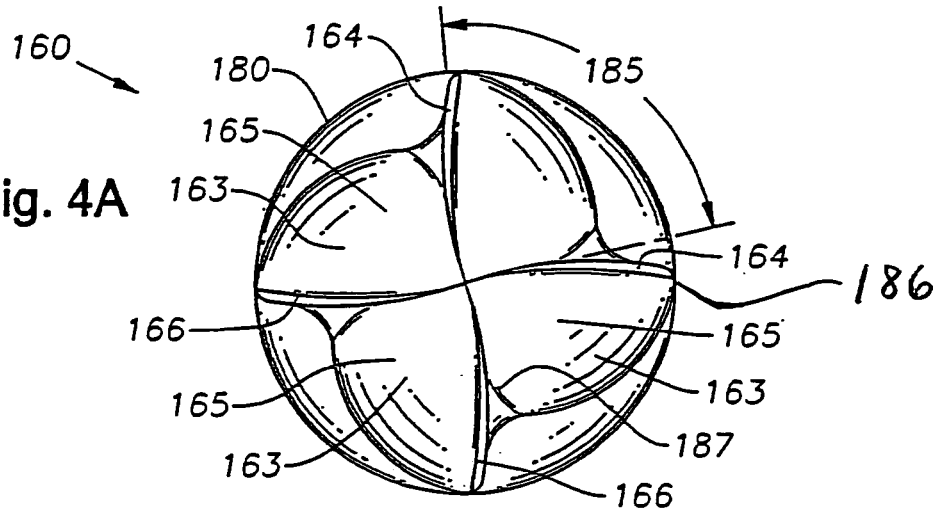
FIG. 4A is a top view of a second embodiment of the present invention.
Figure 4B:
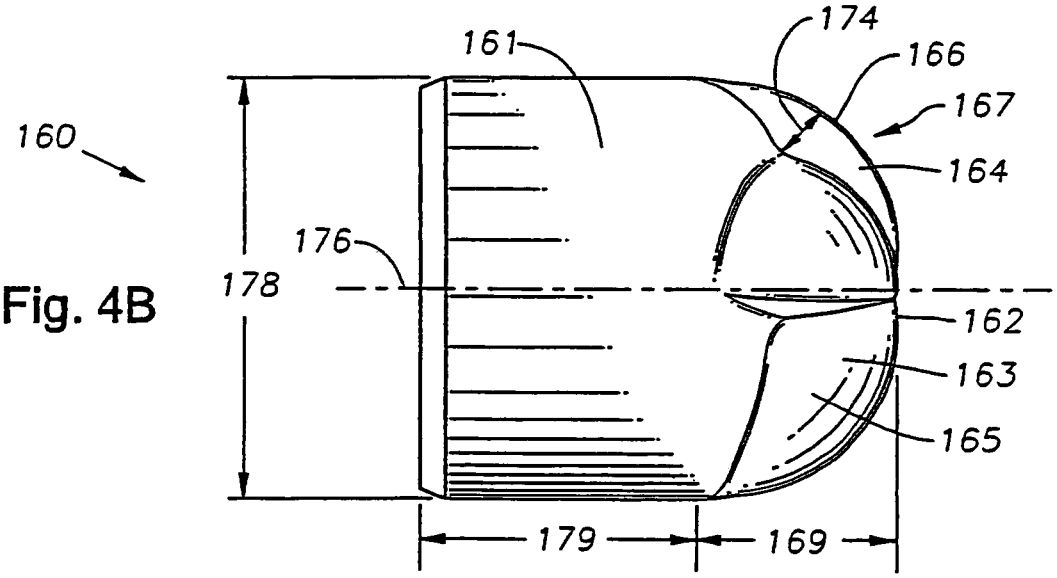
FIG. 4B is a side view of a second embodiment of the present invention.
Figure 4C:
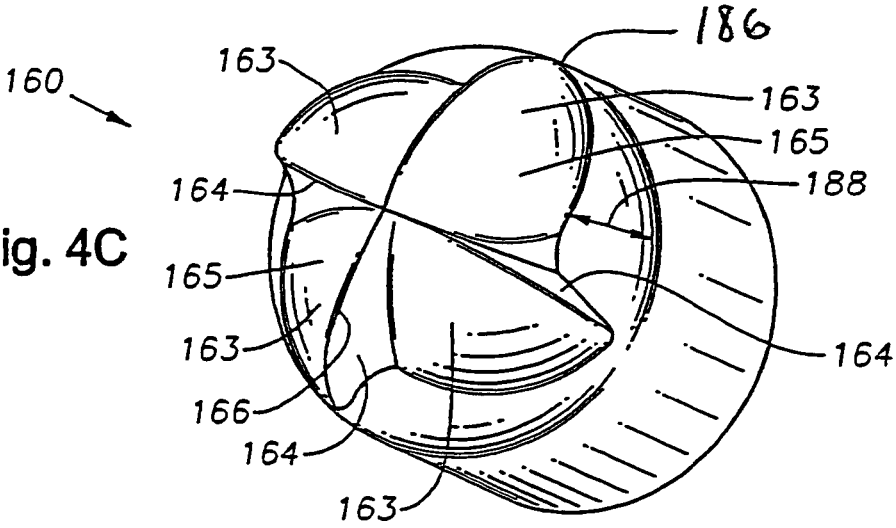
FIG. 4C is a perspective view of a second embodiment of the present invention.

Another embodiment of the preferred cutter element is shown in FIGS. 4A–4C. This embodiment includes cutter element 160 having base 161 and cutting portion 162 that includes four lobes 163 having forward facing surfaces 164 and partial dome shaped trailing surfaces 165 which intersect in a relatively sharp and curved cutting edge 166. Trailing surface 165 includes a leading end 186 adjacent to cutting edge 166 and a trailing end 187. Base 161 has a height 179, diameter 178 and outer profile 180. Cutting portion 162 includes an extension height 169. As best shown in FIG. 4A, the angular length of 185 of each lobe 163 is approximately 90° as the trailing end 187 of the dome shaped trailing surface 165 is substantially aligned with the forward facing surface 164 of the next adjacent lobe 163. Trailing end 187 of partial dome portion 165 is recessed from the profile 180 of base 161 to a greater extent than is the leading end 186, such recess being designated by reference numeral 188 on FIG. 4C. Again, this facilitates cleaning of the cutter element 160 for enhanced cutting action. As compared to the cutter element 60 shown in FIGS. 3A–3C, the cutter element 160 of FIGS. 4A–4C is generally intended for harder formations. Comparing FIG. 4B and FIG. 3B, the embodiment shown in FIG. 4B includes a cutting edge 166 having a greater radius of curvature 167 and a blade height 174 that is less than that of insert 60 of FIGS. 3A–3C. Accordingly, the partial dome shaped trailing portion 165 of insert 160 has a greater angular length than the lobes 63 on insert 60. Further, the height of forward facing surface 164 of insert 160 that is less than that of the insert 60 shown in FIGS. 3A–3C. The lobes 163 of insert 160 do not extend beyond the outer profile of insert base 161 as best shown in FIG. 4A, 4B. Collectively, these features provide a more robust cutter element, one better suited for withstanding cutting duties associated with harder formations.

Figure 5A:
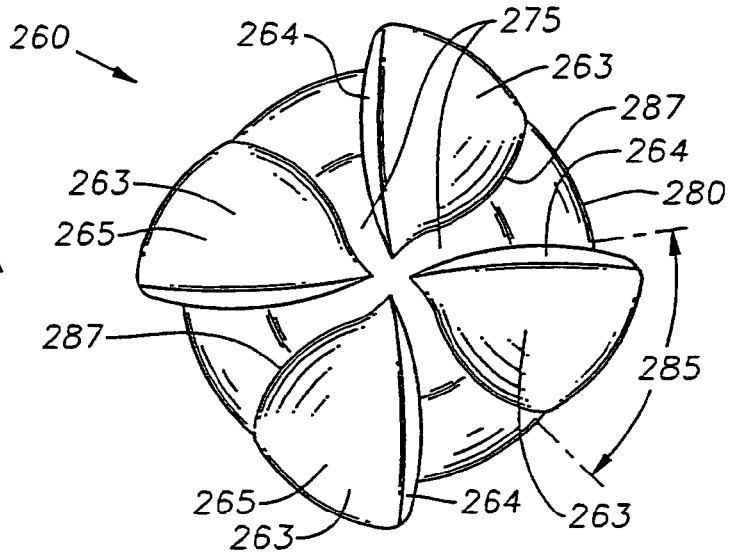
FIG. 5A is a top view of a third embodiment of the present invention.
Figure 5B:
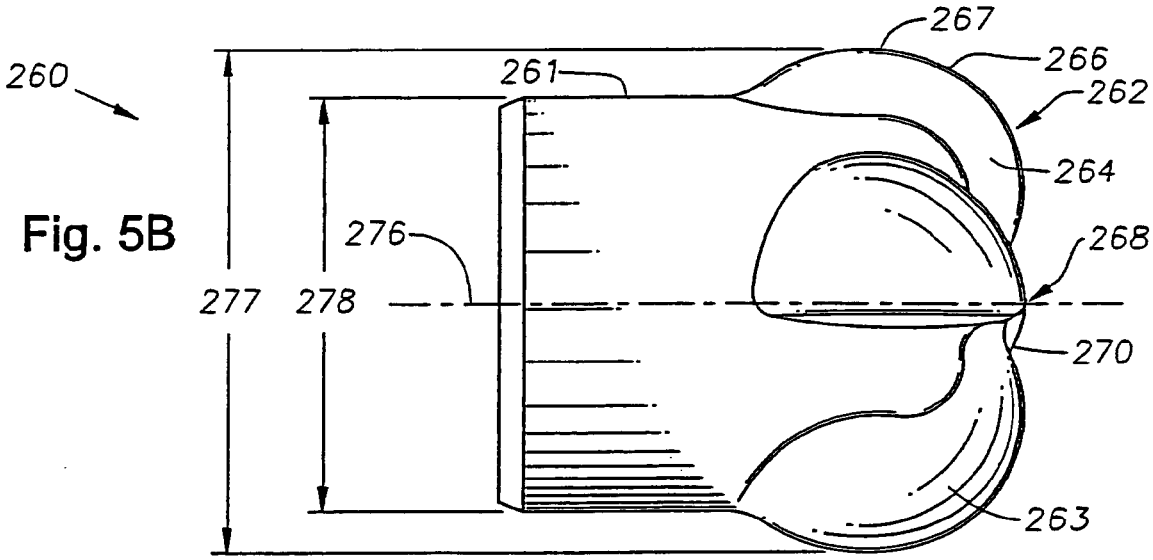
FIG. 5B is a side view of a third embodiment of the present invention.
Figure 5C:
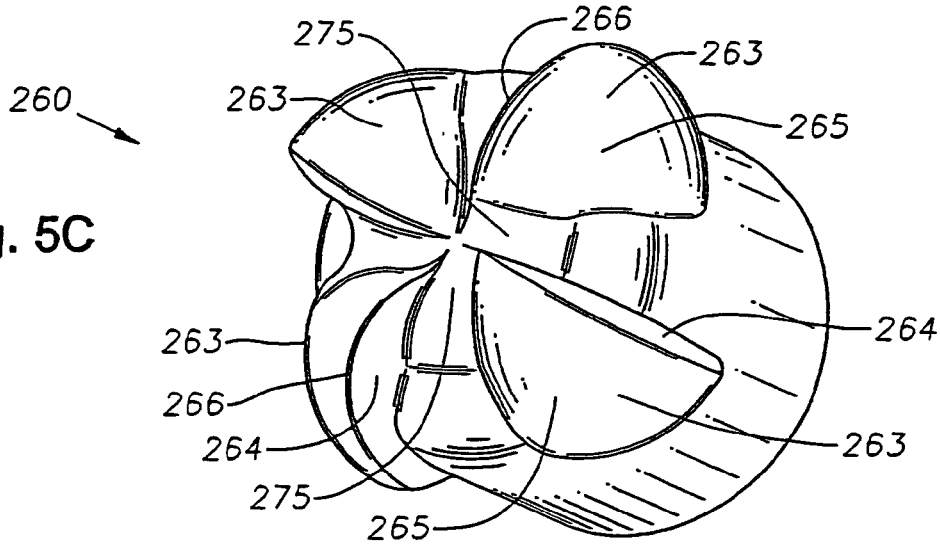
FIG. 5C is a perspective view of a third embodiment of the present invention.

Referring now to FIGS. 5A–5C, another preferred cutter element 260 is shown. Cutter element 260 includes base 261 and cutting portion 262 which includes four radially extending lobes 263. As best shown in FIG. 5B, lobes 263 extend beyond the outer profile 280 of base portion 261 as defined by diameter 278. Cutting portion 262 thus has what may be referred to as a negative draft, with respect to the base portion 261 which permits a greater area of the bottom hole to be cut than could be accomplished with a cutter element having a zero or positive draft such as elements 60, 160 previously described. Methods of manufacturing cutter element inserts having negative drafts are known as described, for example, in U.S. Pat. No. 6,241,034.

A cutter element 260 such as that shown in FIGS. 5A–5C with its lobes 263 extending beyond the profile of the base 261 to a diameter 277 that exceeds diameter 278 of base 261 is particularly well suited for softer formations. Each partial domed shaped trailing portion 265 extends about the cutting portion as measured by an angular length 285. The trailing end 287 of partial dome portion 265 is separated from the forward facing cutting surface 264 of the adjacent lobe 263 by channel 275. Channels 275 radiate from the point of intersection 268 of axis 276 and cutting surface 270. As compared to the inserts 60, 160 of FIGS. 3 and 4, the lobes 263 in the embodiment of FIGS. 5A–5C include a longer cutting edge 266. The radius of curvature 267 along cutting edge 266 changes along the length of edge 266. Likewise, the embodiment shown in FIGS. 5A–5C include a forward facing cutting surface 264 that is larger in area than the corresponding cutting faces 64, 164 of the inserts in FIGS. 3, 4. Accordingly, the insert 260 is capable of removing formation material at a faster rate than insert 60, 160 previously described; however, insert 260 would be more vulnerable to breakage and damage in harder formation than elements 60 and 160.

While the preferred embodiments described above are shown having four lobes per insert, it should be understood that the number of lobes may vary depending upon the application. Thus, for example, inserts 60, 160, 260 may instead be formed having two, three or even five or more lobes. Further, although the lobe's forward facing cutting surfaces previously discussed have been shown and described as being generally planar, and parallel to the central axis of the insert, that cutting surface may instead be angled relative to the insert's axis, and may be entirely curved or have non-planar regions for use in the softer formations.

Figure 6:
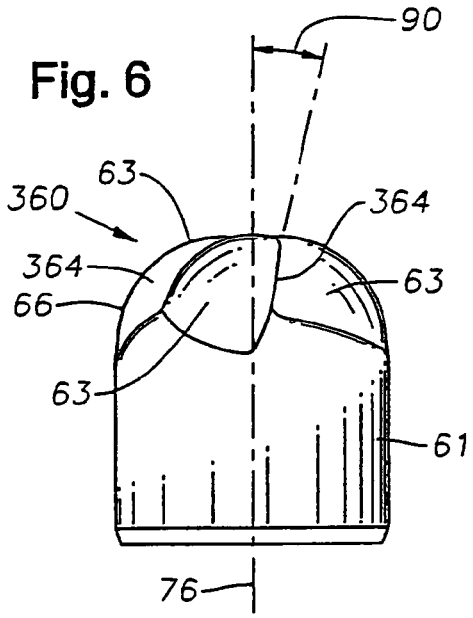
FIG. 6 is a side view of another embodiment of the present invention.
Figure 7:
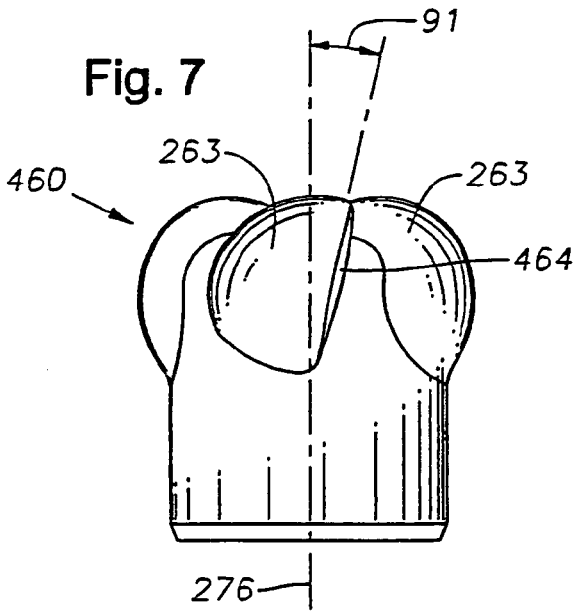
FIG. 7 is a side view of another embodiment of the present invention.
Figure 8:
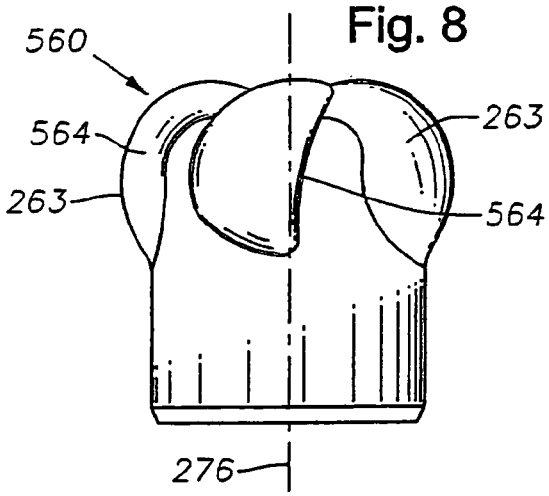
FIG. 8 is a side view of a further embodiment of the present invention.
Figure 9:
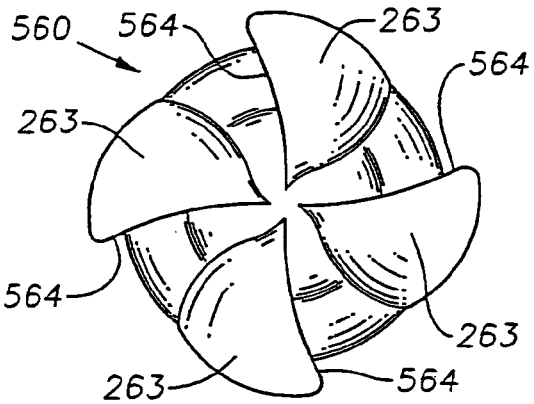
FIG. 9 is a top view of the cutter element shown in FIG. 8.

For example, referring to FIG. 6, an insert 360 substantially similar to insert 60 previously described is shown having forward facing surface 364 that is canted away from central axis 76 at an angle 90. Likewise, referring to FIG. 7, an insert 460 is shown that is substantially the same as insert 260 previously described, except that forward facing cutting face 464 extends at an angle 91 relative to central axis 76. Referring to FIGS. 8 and 9, a cutter element 560 is shown that is substantially identical to element 260, except that forward facing surfaces 564 on lobes 263 are generally curved to form an aggressive, scoop or shovel shaped cutting face.

Figure 10:
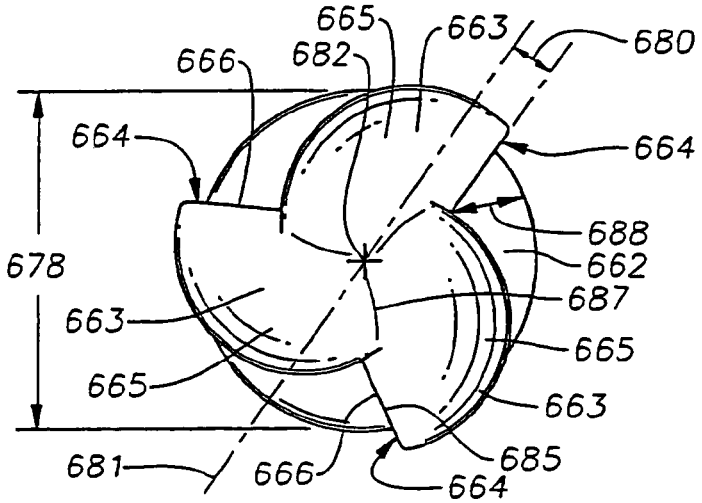
FIG. 10 is a top view of still a further embodiment of the present invention.

Another preferred cutter element 660 is shown in FIG. 10. Cutter element 660 includes cutting portion 662 having three radially extending lobes 663 which extend beyond the outer profile of the base portion of the cutter element having diameter 678. Each lobe 263 includes forward facing cutting surface 664 and trailing portion 665 intersecting in non-linear cutting edges 666.

Referring momentarily to FIG. 4A, the forward facing cutting surfaces 164 are generally co-planar with a plane containing the central axis 176. Referring again to FIG. 10, it can be seen that in cutter element 660, the forward facing cutting surface 664 is spaced apart or offset a distance 680 from a plane 681 passing through and containing insert central axis 682. Trailing surface 665 of each lobe 663 includes a leading end 685 and a trailing end 687. Trailing end 687 is recessed or set back from the outer diameter 678 or profile of the cutter element's base a substantial distance as designated by reference numeral 688. This cutting structure having cutting faces 664 extending beyond diameter 678 and having the trailing end 687 of the trailing surface 665 recessed provides an aggressive cutting structure, particularly advantageous in soft formations, and a cutting structure that facilitates cleaning due, in part, to the substantial recess or set back 688.

Figure 11A:
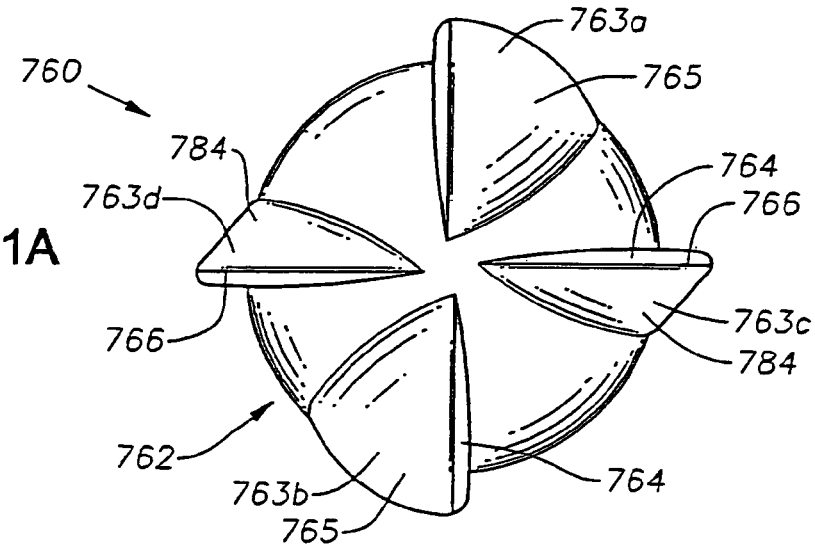
FIG. 11A is a top view of a further embodiment of the present invention.
Figure 11B:
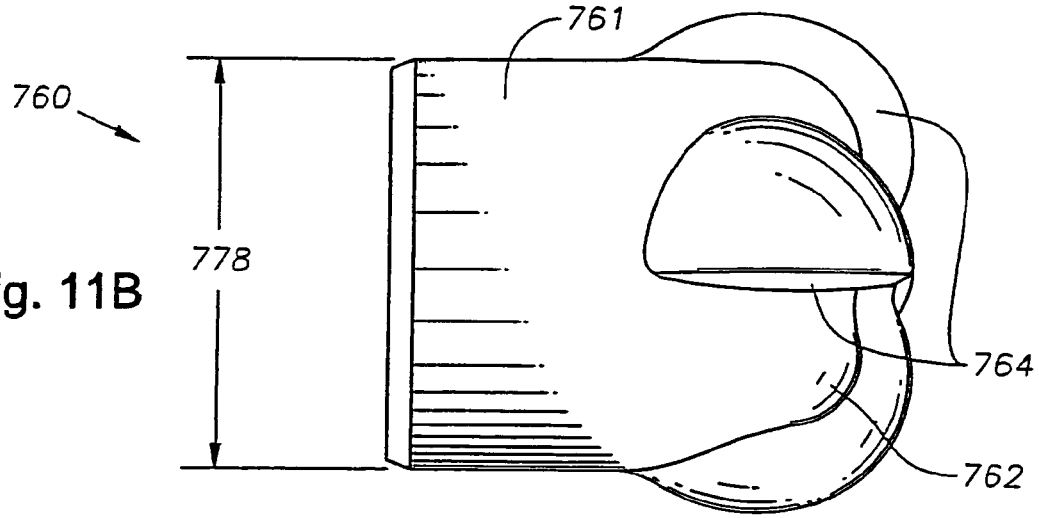
FIG. 11B is a side view of the cutter element shown in FIG. 11A.
Figure 11C:
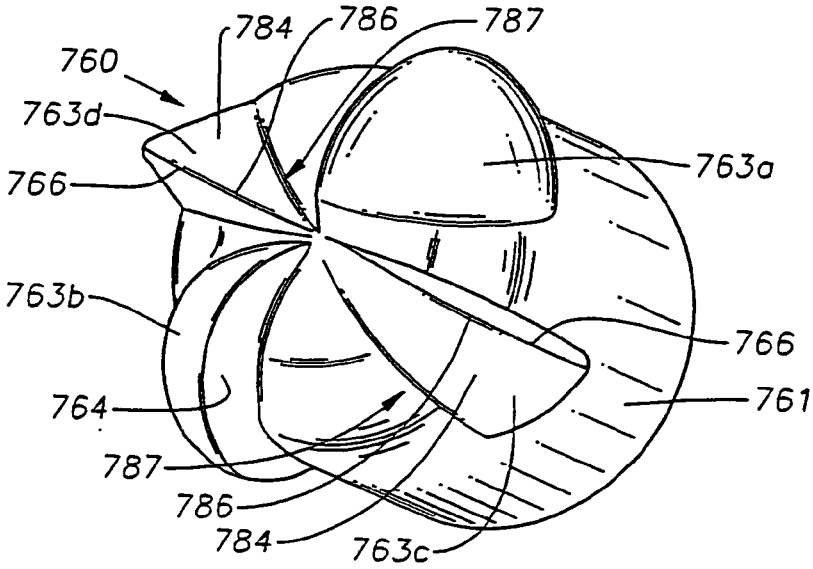
FIG. 11C is a perspective view of the cutter element shown in FIG. 11A.

As described previously, to provide the desired enhanced cutting action, the multilobed cutter elements described above include lobes having forward facing cutting surfaces and trailing portions with curved trailing surfaces to buttress or support the forward facing surface. This structure is to be distinguished from a blade or paddle-like appendage extending from a cutter element where the forward facing and trailing surfaces are each generally planar. Without a lobe having a buttressing portion with a trailing surface tapering away from the outer extension of the forward facing cutting face towards the axis of the cutter element, the strength and durability necessary for cutting in hard formations will not be present. In the embodiments described herein, the buttressing portion that trails the forward facing cutting surface may be partially dome shaped, as previously described, or may have other non-planar surfaces shaped to curve or taper away from the outermost extension of the lobe towards the axis of the cutter element. For example, referring to FIGS. 11A–11C, a cutter element 760 is shown having base portion 761, and a cutting portion 762 having four lobes 763*a-d* extending beyond the diameter 778 of base 761. Lobes 763 include forward facing cutter surfaces 764 and trailing portions 765 that taper away from cutting edge 766. In the case of lobes 763*a, b*, trailing surface 765 recedes away in a surface having a generally spherical radius. In the case of lobes 763*c, d*, trailing surface 765 recedes away from cutting edge 766 via a generally frustoconical taper. More specifically, as best shown in FIG. 11A, lobes 763*a, b*, include partial domed shaped trailing portion 765. Lobes 763*c, d* include trailing portions 765 that are differently shaped, and that include a generally frustoconical segment 784 tapering away from cutting edge 766. As best shown in FIG. 11C, surface segment 784 includes leading end 786 and trailing end 787 and is non-planar and tapers continuously from cutting edge 766 to trailing end 787. In this manner, lobes 763*c, d* provide ample support for the generally planar, forward facing cutting surfaces 764, although they would not be as robust as cutting lobes 763*a, b*.

While various preferred embodiments of the invention have been shown and described, modifications thereof can be made by one skilled in the art without departing from the spirit and teachings of the invention. The embodiments herein are exemplary only, and are not limiting. Accordingly, the scope of protection is not limited by the description set out above, but is only limited by the claims which follow, that scope including all equivalents of the subject matter of the claims.

What is claimed is:

1. A cutter element for a drill bit comprising:

a base portion and a cutting portion extending from said base portion along a central axis;

said base portion comprising a generally cylindrical member having a generally circular cross-section for insertion into a generally circular bore in a drill bit; and said cutting portion comprising a plurality of radiating lobes, said lobes having a generally planar forward facing cutting surface and a partially dome shaped trailing surface buttressing said generally planar forward facing cutting surface.

2. The cutter element of claim 1 wherein said generally planar forward facing cutting surface is offset a predetermined distance from a plane containing said central axis.

3. The cutter element of claim 1 wherein said generally planar forward facing cutting surface and said partially dome shaped trailing surface meet to form a nonlinear cutting edge.

4. The cutter element of claim 3 wherein said nonlinear cutting edge has a radius of curvature that changes along its length.

5. The cutter element of claim 3 wherein said partial dome shaped trailing surface comprises a leading end and a trailing end, said leading end being coextensive with said cutting edge and said trailing end being angularly spaced from said leading end.

6. The cutter element of claim 5 wherein said trailing end is angularly spaced more than forty-five degrees from said leading end.

7. The cutter element of claim 5 wherein said trailing end is angularly spaced more than seventy degrees from said leading end.

8. The cutter element of claim 5 wherein said base portion comprises an outer profile and said trailing end is recessed from said profile to a greater extent than said leading end is recessed from said profile.

9. The cutter element of claim 1 wherein said base portion comprises an outer profile and said lobes extend beyond said outer profile.

10. The cutter element of claim 1 wherein said lobes are separated by a plurality of channels.

11. The cutter element of claim 1 wherein said forward facing cutting surface is canted away from said central axis.

12. The cutter element of claim 1 wherein said trailing surface comprises a generally spherical radius.

13. A cutter element for a drill bit comprising:

a base portion and a cutting portion extending from said base portion along a central axis;

said base portion comprising a generally cylindrical member having a generally circular cross-section for insertion into a generally circular bore in a drill bit; and said cutting portion comprising a plurality of radiating lobes, said lobes having a generally planar forward facing cutting surface and a trailing surface buttressing said forward facing cutting surface, wherein said forward facing cutting surface and said trailing surface meet to form a cutting edge and said trailing surface recedes away from said cutting edge via a generally frustoconical taper.

14. A drill bit for drilling through earthen formation and forming a borehole, comprising:

at least one rolling cone cutter rotatably mounted on the drill bit for rotation in a cutting direction of rotation, said rolling cone cutter comprising at least one hole; and a cutter element mounted in said hole of said rolling cone cutter, said cutter element comprising:

a base portion and a cutting portion extending from said base portion along a central axis; and said cutting portion comprising a plurality of radiating lobes, said lobes having a generally planar forward facing cutting surface and a partially dome shaped trailing surface buttressing said generally planar forward facing cutting surface.

15. The drill bit of claim 14 wherein said forward facing cutting surface is offset a predetermined distance from a plane containing said central axis.

16. The drill bit of claim 14 wherein said generally planar forward facing cutting surface and said partially dome shaped trailing surface meet to form a nonlinear cutting edge.

17. The drill bit of claim 16 wherein said nonlinear cutting edge has a radius of curvature that changes along its length.

18. The drill bit of claim 16 wherein said partial dome shaped trailing surface comprises a leading end and a trailing end, said leading end being coextensive with said cutting edge and said trailing end being angularly spaced from said leading end.

19. The drill bit of claim 18 wherein said trailing end is angularly spaced more than forty-five degrees from said leading end.

20. The drill bit of claim 18 wherein said base portion comprises an outer profile and said trailing end is recessed from said profile to a greater extent than said leading end is recessed from said profile.

21. The drill bit of claim 14 wherein said trailing surface comprises a generally spherical radius.

* * * * *